United States Patent [19]

Schönheit

[11] Patent Number: 5,060,565

[45] Date of Patent: Oct. 29, 1991

[54] SMOOTHING AND CALIBRATING OF PAPER

[75] Inventor: Friedrich-Wilhelm Schönheit, Osnabruck, Fed. Rep. of Germany

[73] Assignee: Felex Schoeller Jr. GmbH & Co., Osnabruck, Fed. Rep. of Germany

[21] Appl. No.: 454,516

[22] Filed: Dec. 21, 1989

[30] Foreign Application Priority Data

Dec. 22, 1988 [EP] European Pat. Off. ..... 88 121 477.9

[51] Int. Cl.[5] ..... B30B 15/34; B30B 3/04

[52] U.S. Cl. ..... 100/93 RP; 100/162 R; 100/162 B; 100/166

[58] Field of Search ..... 100/162 B, 162 R, 161, 100/93 RP, 166

[56] References Cited

U.S. PATENT DOCUMENTS

| | | | |
|---|---|---|---|
| 1,326,615 | 12/1919 | Pope | 100/93 RP |
| 1,934,233 | 11/1933 | Malkin | 100/162 R |
| 2,993,432 | 7/1961 | Youngchild | 100/162 B X |
| 3,177,799 | 4/1965 | Justus et al. | 100/93 RP |
| 4,653,395 | 3/1987 | Verkasalo | 100/93 RP X |

FOREIGN PATENT DOCUMENTS

| | | | |
|---|---|---|---|
| 509596 | 11/1955 | Fed. Rep. of Germany | 100/162 R |
| 1080392 | 4/1960 | Fed. Rep. of Germany | 100/162 R |
| 1086120 | 7/1960 | Fed. Rep. of Germany | 100/162 R |
| 2420563 | 10/1975 | Fed. Rep. of Germany | 100/161 |

OTHER PUBLICATIONS

*Wochenblatt Fur Papierfabrikation*, 10/1987, p. 435.

Smook, Handbook for Pulp and Paper Technologists, 1982, pp. 254–258.

*Das Papier*, vol. 42, No. 7, 1988, pp. 326 and 328.

*Primary Examiner*—Harvey C. Hornsby

*Assistant Examiner*—Stephen F. Gerrity

*Attorney, Agent, or Firm*—Lockwood, Alex, FitzGibbon & Cummings

[57] ABSTRACT

The smoothing and calibrating of paper is described which utilizes a calender mechanism, particularly in its application to the production of photographic base paper in a papermaking line, and in which hard cylinders are positioned next to each other in which adjacent cylinders are of different diameters.

10 Claims, 1 Drawing Sheet

SMOOTHING AND CALIBRATING OF PAPER

BACKGROUND AND DESCRIPTION OF INVENTION

Figure 1:
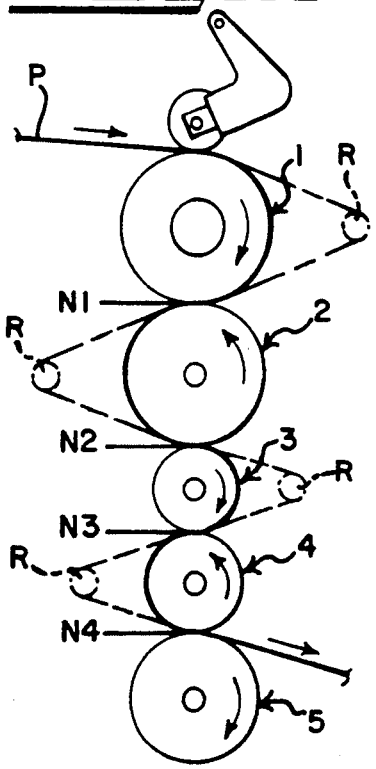

The invention relates to the smoothing and calibrating of papers and, more particularly, to the smoothing and calibrating of papers using at least four hard cylinders positioned next to one another.

In order to change the surface characteristics of a paper without applying additional layers, different calendar devices, in in-line as well as off-line arrangements, have been used throughout the paper industry. Both of these devices smooth, flatten and compress the paper.

In-line arranged calendar devices generally comprise several hard cylinders, such as for example steel, which are positioned above one another. The paper sheet proceeds through the nips of the "hard" cylinders and, depending on the pressure applied, is compressed and smoothed.

Off-line arranged calenders generally consist of several cylinders positioned above one another and in which hard cylinders, such as for example steel, alternate with soft cylinders, as for example paper coated steel cylinders. In these calenders the paper sheet passes also through the cylinder nips and, depending on the pressure applied, is compressed and smoothed.

Different results can be attained through the use of different cylinder combinations so that different areas of application have also arisen for both in-line and off-line calendering arrangements.

Calendar devices which comprise only hard cylinders are generally integrated into paper machines, i.e. in-line and compress and smooth the paper with pressure radially directed. Variations in the thickness of the paper are balanced out and the paper is calibrated resulting in a compressed paper with a flattened surface. For this purpose, irregular density reduction in thickness, stiffness and opacity, as well as in extreme cases, mottled gloss on the surface must be taken into consideration.

Calender mechanisms with a combination of hard and soft cylinders which are generally operated as separate assemblies, compress the paper and additional deformation forces are applied through a fulling operation in the cylinder nips. Through the fulling operation in addition to the compression of the paper, differences in the density of the paper are balanced out in the borders, resulting in a uniformly compressed paper with a more uniform gloss and on the whole a smoother but less even surface. For this purpose, reduction in thickness, stiffness and opacity must be taken into consideration.

The degree of the fundamentally different effects of both mechanisms described above are also dependent on the construction of the paper, its moisture content and its composition, as well as on the level of pressure applied and the temperature of the sheet during processing.

Layer support materials for light sensitive layers should have highly even surfaces to thoroughly prevent "photographic mottles". The concept of photographic "mottles" is described in DE 34 26 782. In order to attain a highly uniform final product, the base paper must have as flat a surface as possible. Calender mechanisms which predominantly produce luster and smoothness therefore have not proved valuable for the production of base papers for layer supports of light sensitive materials. Calendars comprising only hard cylinders are preferably used for the flattening of the paper surfaces.

These calenders consist of 2 to 10 cylinders which are generally positioned vertically above one another and preferably positioned in a paper making machine between the drying and the winding units. The lowest support cylinder (king roll) is provided with a drive unit, can be embossed and is larger in diameter than the remaining cylinders. The remaining cylinders as a rule generally have the same diameter. Frequently, however, the highest cylinder and the cylinder which is second to the bottom (queen roll) are slightly greater in diameter than the others. A known in-line calender (machine calender) is described, for example, in G.A. Smook, *Handbook for Pulp and Paper Technologists,* 1982 edition, pages 254–258.

The pressure applied through the specific weight of the cylinders themselves of a machine calender is generally too low to calibrate a paper, that is to say to provide a paper with a uniform thickness at all places. The calender therefore is additionally loaded with pressure. During pressure loading, however, the stacked cylinders in a calender tend to change their position and are laterally displaced. Even small changes in the position of a cylinder can be discernible through a changed thickness profile of the paper measured laterally over the sheet. The more cylinders a calender has, the lower the additional pressure can be, but the more difficult it becomes to ensure the precise fixing of the cylinder position. Fewer cylinders, on the other hand, require a greater pressure. In practice, therefore, machine calenders with 4 to 7 cylinders are preferred.

The number of cylinders and the pressure load must always be adjusted corresponding to the requirements of the paper. In relatively high compressions, such as are desired and customary in the production of photographic base papers, machine calenders with 8 to 14 cylinders, therefore, are preferred. A smaller number of cylinders would necessitate a higher pressure which could result in a partial destruction of the fiber structure. Even with the 8 to 14 cylinder high pressure calenders, linear pressures of up to 300 N/mm or greater can be experienced. This pressure range is intended for the described "displacement" of the calender cylinders.

In addition to a volume reduction of the paper, higher pressure in the cylinder nips causes an increase in the width (lateral expansion) of the sheet of paper. The paper sheet fixed in the cylinder nip cannot, however, freely expand in width. An excessively large pressure load in the first cylinder nip of a calender can lead to longitudinal folds in the paper which under certain circumstances are pressed in and can damage the cylinder surfaces. This danger is greater with lower surface weight (Compare: *Wochenblatt fur Papierfabrikation* [*A Weekly Journal of Paper Manufacturing*]22, 1985, page 859). Thus, even high pressure calenders with 7 to 14 cylinders in many cases do not realize the desired compression without suffering disadvantages at the same time.

Furthermore, it has been found that small hollow bubbles occur with high compression of the base paper in the first nip, due to the inclusion of air in the nonwoven paper base. This is disadvantageous because during the successively following two-sided extrusion coating with polyolefin resin of the compressed base paper, air remaining in the hollow bubbles expands during heating. During the course of the subsequent cooling which takes place during contact with the cooling cylinder, the enclosed air bubbles contract and the polyolefin film located above the bubbles falls into tiny depressions or so-called "pits". After later emulsifying and developing, these "pits" are clearly visible as undesireable disturbances in the photographic image. This phenomenon also places limits on the use of high pressure calenders.

Moreover, in conventional calenders with cylinders of the same diameter and in certain ranges of sheet speed, variations in resonance disadvantageously appear in the cylinders. These variations have resulted in markings proceeding laterally over the paper sheet consisting of strips of varying compression. Even after polyolefin resin coating, they continue to remain visible as a surface disturbance. This disadvantage places certain limits on the desirably continuous change or adjustment of the machine speed.

Finally, the crowning of the support cylinder (king roll) as well as the crowning of one or two additional cylinders in calenders have also proven disadvantageous because the flexibility of the apparatus is thereby limited to a few pairings of surface compression. In particular in this connection, the cylinder temperatures which vary with the operating and external conditions are disadvantageous. Machine calenders through which the paper exiting the dry part of a paper machine proceeds, have considerable temperature variations which frequently result in additional deformations of the cylinders and therefore in thickness differences of the paper between the sheet center and edge. These can not be eliminated by means of cylinder crowning.

It is the task of the present invention to propose a mechanism and a process for avoiding the disadvantages stated hereinabove and by which a "pit" free paper with a highly even surface is obtained.

In accordance with the invention, both the first cylinder into the nip of which the paper first passes are of greater diameter than the remaining cylinders apart from the king roll. The ratio of diameters of the larger cylinders to the diameters of the smaller cylinders lies in the range of 1:0.45–0.70. It is important in this connection that the ratio between the length and the diameter of the larger cylinders is held between 4:1 and 8:1, inclusive, and of the smaller cylinders is held between 10:1 and 14:1, inclusive. The first and the last cylinder can be zone controlled bending compensation cylinders. See for example G. A. Smook, *Handbook for Pulp and Paper Technologists,* 1982 edition, pages 255–56. It has been found that a quality increase of the paper takes place without the occurrence of the aforementioned disadvantages. This applies for all papers, semi-cardboards and cardboards. The papers or cardboards can be worked either with or without the use of filling materials. Experiments have been carried out with papers having basis weights between 50 g/m$^2$ and 300 g/m$^2$ both with, as well as without the use of filling material. The mechanism may also include reversal rolls beside the calender cylinders if desired. See for example *Wochenblatt fur Manufacturing,* [*A Weekly Journal of Paper Manufacturing*]10, 1987, page 435 , FIG. 4.

With the exception of the zone controlled bending compensation cylinders, the other cylinders can favorably be temperature/controlled by passing water through them to remove thermal energy or to heat the cylinders, e.g. up to 100° C. for special smoothing and calibrating effects. The temperature also may be increased by the use of steam or oil instead of water.

The invention will now be illustrated in greater detail by means of the two following examples. In one particular form of execution, the calender comprises at least three hard cylinders which are positioned next to one another. In this execution a king roll which is larger in diameter is eliminated and only one of the two larger cylinders is constructed as a zone controlled bending compensation cylinder. This smoothing mechanism, likewise, operates in accordance with the invention, but is only preferably used for smaller paper sheet operations.

Figure 2:
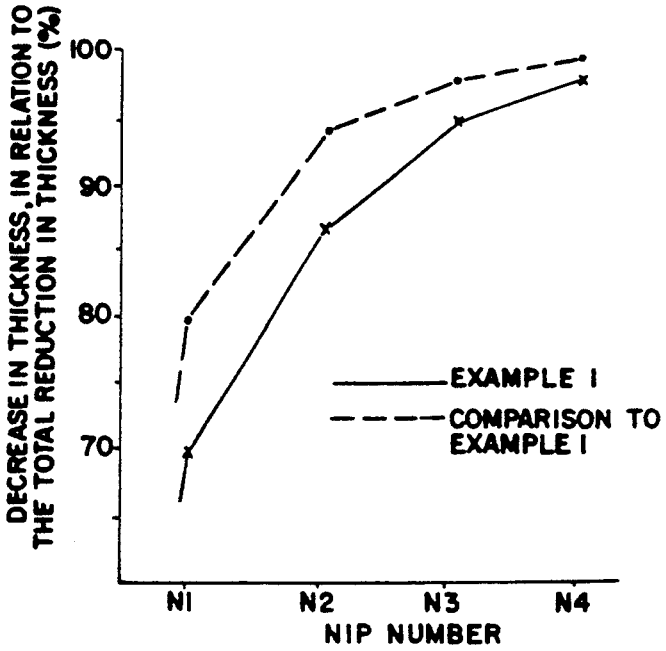

In the drawings,

FIG. 1 schematically depicts the calender as shown in solid which is employed inperforming Example 1 and FIG. 2 depicts the individual stages of smoothing and calibrating of Example 1 and the comparison to that example.

Figure 3:
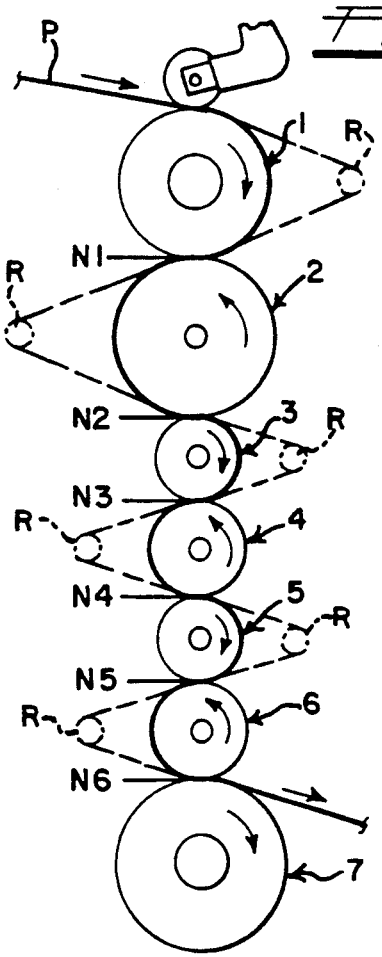
Figure 4:
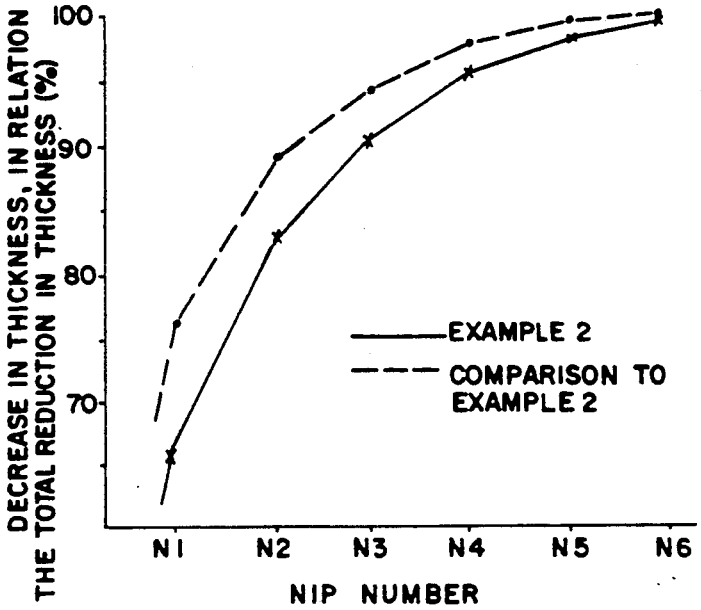

FIG. 3 schematically depicts the calender as shown in solid which is employed in performing Example 2 and FIG. 4 depicts the individual stages of smoothing and calibrating of Example 2 and the comparison to that example. Optionally reversal rolls R may be employed if desired in the calenders as shown in dot and dash in FIGS. 1 and 3.

Thermal energy may also be added to or removed from one or more of the cylinders by conduits C as depicted schematically in dot and dash in FIGS. 1 and 3.

EXAMPLE 1

As shown schematically in solid in FIG. 1, a photogrpahic base paper P, 180 g/m$^2$ in weight, with a specific volume of 1.33 cm$^3$/g, was smoothed and calibrated with a 5-cylinder machine calender having nips N1–N4 therebetween.

The calender contained the following hard cylinder combination:

| | |
|---|---|
| Cylinder 1 (above) | 700 mm diameter |
| 2 | 650 mm diameter |
| 3 | 400 mm diameter |
| 4 | 450 mm diameter |
| 5 (below) | 600 mm diameter |

Cylinder 1 was a zone controlled bending compensation cylinder.

The linear pressure in the nip N3 was 220 N/mm.

As previously stated, the individual stages of smoothing and calibrating are shown in FIG. 2.

EXAMPLE 2

As shown schematically in solid in FIG. 3, a photographic base paper P, 150 g/m$^2$ in weight, with a specific volume of 1.35 cm$^3$/g, was smoothed and caliberated with a 7-cylinder machine calender having nips N1–N6 therebetween.

The calender contained the following hard cylinder combination:

| | |
|---|---|
| Cylinder 1 (above) | 710 mm diameter |
| 2 | 760 mm diameter |
| 3 | 400 mm diameter |
| 4 | 450 mm diameter |
| 5 | 400 mm diameter |
| 6 | 450 mm diameter |
| 7 (below) | 820 mm diameter |

Cylinders 1 and 7 were zone controlled bending compensation cylinders (Nipco cylinders) and cylinder 7 is the king roll.

The linear pressure in the nip N5 was 180 N/mm.

As previously stated, the individual stages of smoothing and calibrating are shown in FIG. 4.

Comparison to Example 1

The photographic base paper from Example 1 was smoothed and calibrated by means of a conventional 5-cylinder machine calender.

The calender contained the following hard cylinder combinations:

| | |
|---|---|
| Cylinder 1 (above) | 500 mm diameter |
| 2 | 400 mm diameter |
| 3 | 400 mm diameter |
| 4 | 400 mm diameter |
| 5 (below) | 600 mm diameter |

The linear pressure in the last second to nip was 220 N/mm.

As previously stated, the individual stages of smoothing and calibrating are shown in FIG. 2.

Comparison to Example 2

The photographic base paper from Example 2 was smoothed and caliberated by means of a conventional 5-cylinder machine calender.

The calender contained the following hard cylinder combinations:

| | |
|---|---|
| Cylinder 1 (above) | 500 mm diameter |
| 2 | 400 mm diameter |
| 3 | 400 mm diameter |
| 4 | 400 mm diameter |
| 5 | 400 mm diameter |
| 6 | 400 mm diameter |
| 7 (below) | 600 mm diameter |

Cylinders 1 and 7 were zone-controlled bending compensation cylinders (Nipco cylinders).

The linear pressure in the second to last nip 180 N/mm.

As previously stated, the individual stages of smoothing and calibrating are shown in FIG. 4.

Description of the Testing Method

1. Specific volume $cm^3/g$=Thickness/Surface weight.

2. Pits-level:

The surface of a paper sample is studied with a microscope. A circular object surface 10 mm in diameter is illuminated at 20× enlargement under glancing light. Under the reflected light, the pits can be seen on an image screen as dark points.

A qualitative evaluation is made, depending on the number and size, whereby 1=no pits and 5=a large number of large pits.

| Example No. | Results: Specific volume after calibration | Pits-level | Folds after 1st nip |
|---|---|---|---|
| 1 | 0.96 | 2 | No |
| 2 | 0.90 | 2 | No |
| Comparison to 1 | 0.93 | 3–4 | Yes |
| Comparison to 2 | 0.89 | 3 | Yes |

The careful compression of the fiber structure makes it possible even under high linear pressures to produce paper free of folds by means of the calender. In particular, the "pits-level" can be significantly reduced by proceeding carefully in the operation of the calender operating in accordance with the invention.

I claim:

1. A smoothing and calibrating mechanism for papers, and particularly for photographic base papers, said mechanism comprising at least four hard cylinders positioned sequentially one adjacent to the next to define a nip between each of the respective adjacent cylinders through which the paper passes between the adjacent cylinders, the first two cylinders between which the paper first passes having a larger diameter than the diameter of the remaining smaller cylinders through and including at least the second to last of the cylinders between which the paper passes; the ratio of the diameters of the larger diameter cylinders to the diameters of the smaller diameter cylinders being between about 1:0.45 to 1:0.70; the larger diameter cylinders having a ratio of cylinder length to cylinder diameter of between about 4:1 to 8:1; the smaller diameter cylinders having a ratio of cylinder length to cylinder diameter of between about 10:1 to 14:1; and wherein at least one of the first and the last cylinders between which the paper passes is a zone controlled bending compensation cylinder.

2. The mechanism of claim 1, wherein adjacent cylinders always have different diameters.

3. The mechanism of claim 2, including means for adding or removing thermal energy to or from the cylinders.

4. The mechanism of claim 1, including means for adding or removing thermal energy to or from the cylinders.

5. The mechanism of claim 1, including at least one reversal cylinder for reversing the direction in which the paper passes between the cylinders.

6. The mechanism of claim 1, wherein the pressure exerted at the nip of the final cylinder through which the paper passes is between about 150 and 300 N/mm, and the pressure exerted at the nip of the first cylinder through which the paper passes is sufficient to reduce the thickness of the paper to about 50 to 70% of the total reduction of thickness by the mechanism.

7. The mechanism of claim 1, wherein the mechanism is an in-line calender.

8. A smoothing and calibrating mechanism for papers, and particularly for photographic base papers, said mechanism comprising at least four hard cylinders positioned sequentially one adjacent to the next to define a nip between each of the respective adjacent cylinders through which the paper passes between the adjacent cylinders, the first two cylinders between which the paper first passes having a larger diameter than the diameter of the remaining smaller cylinders; the ratio of the diameters of the larger diameter cylinders to the diameters of the smaller diameter remaining cylinders being between about 1:0.45 to 1:0.70; the larger diameter cylinders having a ratio of cylinder length to cylinder diameter of between about 4:1 to 8:1; the smaller diameter cylinders having a ratio of cylinder length to cylinder diameter of between about 10:1 to 14:1.

9. The mechanism of claim 8, wherein the pressure exerted at the nip of the final cylinder through which the paper passes is between about 150 to 300 N/mm, and the pressure exerted at the nip of the first cylinder through which the paper passes is sufficient to reduce the thickness of the paper to about 50 to 70% of the total reduction of thickness by the mechanism.

10. The mechanism of claim 8, wherein the mechanism is an in-line calender.

* * * * *

UNITED STATES PATENT AND TRADEMARK OFFICE

CERTIFICATE OF CORRECTION

PATENT NO. : 5,060,565

DATED : October 29, 1991

INVENTOR(S) : Friedrich-Wilhelm Schonheit

It is certified that error appears in the above-identified patent and that said Letters Patent is hereby corrected as shown below:

On the cover sheet of the patent, the name of the assignee should be -- Felix Schoeller Jr. GmbH & Co. --.

In column 3, line 64, delete "temperature/controlled" and insert -- temperature controlled --.

In column 4, line 14, delete "inperforming" and insert -- in performing --.

Column 5, line 28, delete "5-cylinder" and insert -- 7-cylinder --.

In claim 8, column 6, line 46, delete "four" and insert --three--.

Signed and Sealed this

Second Day of March, 1993

*Attest:*

STEPHEN G. KUNIN

*Attesting Officer*

*Acting Commissioner of Patents and Trademarks*